United States Patent [19]

Moertel

[11] 4,125,911

[45] Nov. 21, 1978

[54] ARTICLE WITH VENTING SLIDE FASTENER

[75] Inventor: George B. Moertel, Conneautville, Pa.

[73] Assignee: Textron Inc., Providence, R.I.

[21] Appl. No.: 797,393

[22] Filed: May 16, 1977

[51] Int. Cl.[2] ..... A47C 23/00; A44B 19/00

[52] U.S. Cl. ..... 5/347; 5/339; 24/205 R; 24/205.1 C; 24/205.1 R; 24/205.16 C; 297/453

[58] Field of Search ..... 24/205.16 R, 205.16 C, 24/205.1 R, 205.1 C, 205 R; 297/453; 5/347, 339

[56] References Cited

U.S. PATENT DOCUMENTS

| | | | |
|---|---|---|---|
| 2,068,500 | 1/1937 | Marinsky | 24/205.16 R |
| 2,380,623 | 7/1945 | Winterhalter | 24/205.16 R |
| 2,652,705 | 9/1953 | Weinberg | 24/205.16 R |
| 3,444,598 | 5/1969 | Glindmeyer | 24/205.16 C |
| 3,831,227 | 8/1974 | Beitter | 24/205.16 C |
| 3,975,802 | 8/1976 | Moertel | 24/205.16 C |
| 4,019,227 | 4/1977 | Ebata | 24/205 R |

FOREIGN PATENT DOCUMENTS

| | | | |
|---|---|---|---|
| 2,441,232 | 11/1976 | Fed. Rep. of Germany | 24/205.16 R |

*Primary Examiner*—Bernard A. Gelak
*Attorney, Agent, or Firm*—O'Brien and Marks

[57] ABSTRACT

Venting of articles, such as cushions, pillows, and the like, is provided by holes formed in tapes of slide fasteners which are closures for the articles.

10 Claims, 4 Drawing Figures

ARTICLE WITH VENTING SLIDE FASTENER

BACKGROUND OF THE INVENTION

1. Field of the Invention

This invention relates to articles, such as cushions, pillows, upholstered furniture, etc. which require venting and include a slide fastener.

2. Description of the Prior Art

In the prior art, articles such as cushions were vented with separate perforated strips or devices attached thereto, or perforations were formed in portions of the article; these separate strips or devices, or the perforation of portions of the articles added substantially to the cost of the articles and required extra steps in the manufacture of the articles.

U.S. Pat. Nos. 2,701,222 and 3,444,598 disclose slide fasteners with holes or apertures formed in the tapes thereof for receiving reflowed thermoplastic material or receiving knitting or sewing threads to secure the tapes to articles.

SUMMARY OF THE INVENTION

The invention is summarized in an article with a venting slide fastener including a pair of article portions having an opening therebetween, a slide fastener having a pair of support tapes and a pair of trains of interlocking elements secured to the inner edges of the respective tapes, means securing the outer portions of the tapes to the respective article portions leaving intermediate portions of the tapes between the inner edges and the outer portions free of the article portions, and the tapes having perforations in the intermediate portions thereof to form a vent for the article through the opening when the slide fastener is closed.

An object of the invention is to construct a vented article with a slide fastener which is less expense and requires fewer steps in the manufacture thereof.

Another object of the invention is to eliminate the necessity of including a separate venting strip or device or the necessity of perforating portions of an article to vent the article.

In one particularly improved embodiment of the invention the slide fastener tapes have beads encircling the vent holes therein to strengthen the tape and prevent weakness of the vented tape portion.

Other objects, advantages and features of the invention will be apparent from the following description of the preferred embodiments taken in conjunction with the accompanying drawings.

DESCRIPTION OF THE PREFERRED EMBODIMENTS

Figure 1:
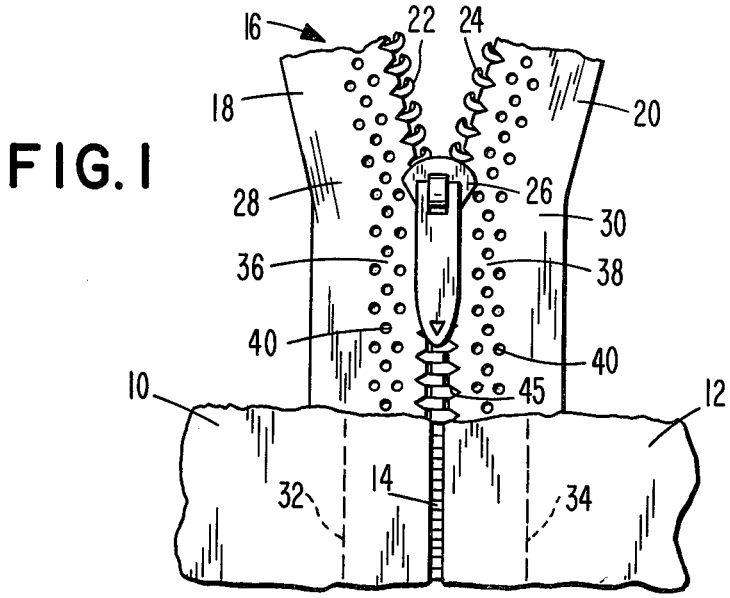
FIG. 1 is a plan view of a broken away portion of an article with a slide fastener in accordance with the invention.
Figure 2:
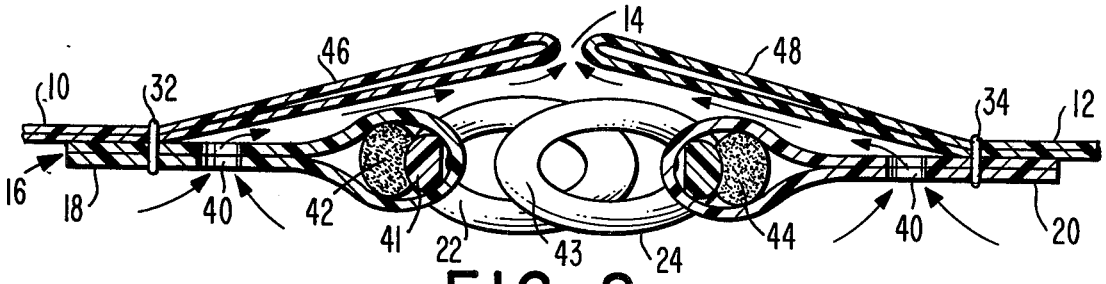
FIG. 2 is an enlarged cross section view of the article portion of FIG. 1.

As illustrated in FIGS. 1 and 2, an article such as a cushion, pillow, or the like in accordance with the invention includes a pair of article portions 10 and 12 with an opening 14 therebetween which is enclosed by a vented slide fastener indicated generally at 16. the slide fastener 16 includes a pair of planarly arranged support tapes 18 and 20 which have respective trains of interlocking elements 22 and 24 mounted on the inner edges thereof. A slider 26 is slidably mounted on the elements 22 and 24 for opening and closing the slide fastener.

The article including the article portions 10 and 12 and the slide fastener 16 is formed from impervious materials, i.e. materials which do not readily permit air to pass therethrough.

The illustrated interlocking element trains 22 and 24 are conventional synthetic polymer spiral coupling elements, but any other type of continuous coupling element or series of elements forming trains of interlocking elements suitably attached to the tapes 18 and 20 may be used.

The tapes 18 and 20 include respective outer portions 28 and 30 which are secured by suitable means, such as stitches 32 and 34, to the respective article portions 10 and 12. Intermediate portins 36 and 38 of the tapes 18 and 20 between the inner edges thereof and the outer portions 28 and 30 are free of the article portions 10 and 12 or are left exposed to communicate with the opening 14 between the article portions 10 and 12. A plurality of perforations, or holes 40 are formed by punching in each of the intermediate portions 36 and 38 to provide a vent for the article. The holes 40 have a size, spacing and quantity selected to provide adequate venting while maintaining sufficient strength in the tapes 18 and 20. Typical sizes for the diameters of the holes 40 range from 0.254 millimeters (0.01 inches) to 2.032 millimeters (0.08 inches).

The tapes 18 and 20 as shown in FIG. 2 are formed from a folded strip of polymer film material with interconnecting or heel portions 41 of the spiral coupling elements 18 and 20 secured within the folded edges along with bead forming cords 42 and 44 by bonding the folded halves of the strip together. Head portions 43 of the spiral coupling elements extend through slots 45 (FIG. 1) in the folded edge to form the interlocking element trains. The strips are biaxially oriented high-density polyethylene film strips formed by laminating two layers of uniaxially oriented material together with the orientation of the two layers crossing. However, the tapes may be any other conventional tapes suitable for use in slide fasteners: such as woven, knitted, or other textile material; thermoplastic, thermosetting or natural materials; different thicknesses or textures; single or multiple plies such as the illustrated double ply; etc.

The article portions 10 and 12 can include respective flaps 46 and 48 which overlie opposite halves of the slide fastener 16 in the opening 14 to hide the slide fastener. As illustrated in FIG. 1, the flaps 46 and 48 pivot outward to permit exhalation of air from the article through the holes 40. The attaching means 32 and 34 must be located laterally outward from the holes 40 to permit this exhalation.

In vented articles, such as cushions, pillows, and the like, the vented slide fastener 16 provides both a closure for an opening in the article as well as providing a vent for the article. This eliminates the need and thus the cost of separate venting strips or devices as well as the separate steps of attaching such strips or device, or eliminate the steps involved in perforating a portion of the article during its manufacture. The tapes of slide fasteners can be easily perforated during their manufacture by automated facilities while still incontinuous strips with very little additional expense or effort whereas previous venting techniques involved additional steps and labor on each individual article. Thus the present article with vented slide fastener results in a substantial savings.

Figure 3:
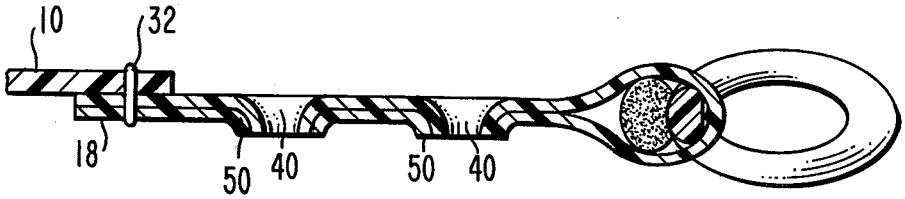
FIG. 3 is a cross section view of a broken away portion of a modified article with a slide fastener in accordance with the invention.

In a modification of the article with vented slide fastener as shown in FIG. 3, the holes 40 are encircled by raised or deformed annular portions 50 of the tapes. By deforming or raising annular portions 50 of the tape 18; the holes 40 are enlarged and reinforcing rims are formed around the holes 40. Thus the tape 18 is made stronger in the modification in FIG. 3 compared to FIG. 2 for the same size of hole.

Figure 4:
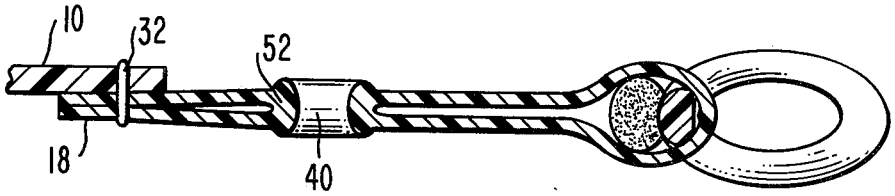
FIG. 4 is a cross section view of a broken away portion of another modified article with a slide fastener in accordance with the invention.

In another modification of the vented slide fastener as shown in FIG. 4, the holes 40 are formed by melting the thermoplastic tape 18 at localized points, for example by a laser beam. This forms annular beads 52 encircling the holes and joining the foled halves of the tape 18 together. The beads have a thickness greater than the combined thicknesses of the folded halves of tape 18. The beads 52 both reinforce the tape around the holes 40 and join the folded halves of the strip of polymer film together.

Since the invention is subject to many modifications, variations, and changes in detail, it is intended that all matter in the foregoing description and shown in the accompanying drawings be interpreted as illustrative and not in a limiting sense.

What is claimed is:

1. A cushion, pillow, or like article with a venting slide fastener comprising a pair of impervious article portions having an opening therebetween, a slide fastener having a pair of support tapes formed from impervious material and having a pair of trains of interlocking elements secured to the inner edges of the respective tapes, means securing outer portions of the tapes to the respective article portions leaving intermediate portions of the tapes between the inner edges and the outer portions free of the article portions, and said tapes having perforations in the intermediate portions thereof to form a vent for the article through the opening when the slide fastener is closed.

2. An article as claimed in claim 1 wherein the perforations have a diameter in the range of 0.254 milimeters to 2.032 milimeters.

3. An article as claimed in claim 1 wherein the tapes are formed from respective strips of polymer film material.

4. An article as claimed in claim 3 wherein the strips of polymer film material are folded longitudinally and the trains of interlocking elements are secured to the folded edges of the strips, said perforations extending through both folded halves of the strips.

5. An article as claimed in claim 4 wherein the folded strips each have a plurality of slots formed therein extending transversely over the folded edge of the strip, and the trains of interlocking elements are continuous coupling elements having head portions extending from the slots and interconnecting portions extending within the folded edge.

6. An article as claimed in claim 1 wherein the support tapes of the slide fastener include reinforcing means encircling each of the perforations.

7. An article with a venting slide fastener comprising a pair of article portions having an opening therebetween, a slide fastener having a pair of support tapes and a pair of trains of interlocking elements secured to the inner edges of the respective tapes, means securing outer portions of the tapes to the respective article portions leaving intermediate portions of the tapes between the inner edges and the outer portions free of the article portions, said tapes having perforations in the intermediate portions thereof to form a vent for the article through the opening when the slide fastener is closed, said tapes being formed from respective strips of polymer film material, said strips of polymer film material being folded longitudinally, said trains of interlocking elements being secured to the folded edges of the strips, said perforations extending through both folded halves of the strips, and beads encircling the perforations, the beads joining the opposite folded halves of the tapes together.

8. An article as claimed in claim 7 wherein the beads have a thickness greater than the combined thickness of the folded halves of the tapes.

9. An article as claimed in claim 6 wherein the reinforcing means includes deformed annular portions of the tapes encircling the perforations.

10. An article as claimed in claim 1 including flap means overlying the slide fasteners to hide the slide fastener, said flap means being mounted so as to permit exhalation through the perforations.

* * * * *